US011585005B2

(12) United States Patent
Tsai et al.

(10) Patent No.: US 11,585,005 B2
(45) Date of Patent: Feb. 21, 2023

(54) APPARATUS AND METHOD FOR WAFER PRE-WETTING

(71) Applicant: Taiwan Semiconductor Manufacturing Company, Ltd., Hsinchu (TW)

(72) Inventors: Chen-Yu Tsai, Hsinchu (TW); Ku-Feng Yang, Hsinchu County (TW); Wen-Chih Chiou, Miaoli County (TW)

(73) Assignee: Taiwan Semiconductor Manufacturing Company, Ltd., Hsinchu (TW)

( * ) Notice: Subject to any disclaimer, the term of this patent is extended or adjusted under 35 U.S.C. 154(b) by 24 days.

(21) Appl. No.: 17/147,471

(22) Filed: Jan. 13, 2021

(65) Prior Publication Data

US 2022/0220624 A1 Jul. 14, 2022

(51) Int. Cl.

| | |
|---|---|
| ***C25D 5/34*** | (2006.01) |
| ***C25D 17/02*** | (2006.01) |
| ***C25D 7/12*** | (2006.01) |
| ***C25D 17/00*** | (2006.01) |

(52) U.S. Cl.

CPC ..... *C25D 5/34* (2013.01); *C25D 7/123* (2013.01); *C25D 17/001* (2013.01); *C25D 17/02* (2013.01)

(58) Field of Classification Search

CPC ..... C25D 7/12–123; C25D 17/001; H01L 21/2885; H01L 21/76873

See application file for complete search history.

(56) References Cited

U.S. PATENT DOCUMENTS

| | | | | |
|---|---|---|---|---|
| 2003/0085118 | A1* | 5/2003 | Tench | C25D 5/08 204/263 |
| 2004/0065540 | A1* | 4/2004 | Mayer | H01L 21/32134 257/E21.309 |
| 2013/0313123 | A1* | 11/2013 | Abraham | C25D 21/10 204/242 |
| 2020/0035484 | A1* | 1/2020 | Oberst | H01L 21/31058 |
| 2022/0112620 | A1* | 4/2022 | Tsuji | C25D 21/12 |

FOREIGN PATENT DOCUMENTS

| | | |
|---|---|---|
| CN | 105304521 | 2/2016 |
| CN | 111146126 | 5/2020 |
| TW | 201404945 | 2/2014 |

OTHER PUBLICATIONS

"Office Action of Taiwan Counterpart Application", dated Oct. 28, 2021, p. 1-p. 8.

* cited by examiner

*Primary Examiner* — Ho-Sung Chung
(74) *Attorney, Agent, or Firm* — JCIPRNET

(57) ABSTRACT

A semiconductor apparatus and methods of processing a semiconductor workpiece are provided. The semiconductor apparatus for pre-wetting a semiconductor workpiece includes a process chamber, a workpiece holder disposed within the process chamber to hold the semiconductor workpiece, a pre-wetting fluid tank disposed outside the process chamber and containing a pre-wetting fluid, and a conduit coupled to the pre-wetting fluid tank and extending into the process chamber. The conduit delivers the pre-wetting fluid from the pre-wetting fluid tank out through an outlet of the conduit to wet a major surface of the semiconductor workpiece comprising a plurality of recess portions.

20 Claims, 10 Drawing Sheets

APPARATUS AND METHOD FOR WAFER PRE-WETTING

BACKGROUND

In the production of advanced semiconductor integrated circuits (ICs), electroplated copper is currently used because copper has a lower electrical resistivity and a higher current carrying capacity. However, the copper electroplating process may produce conductive features with defects. For example, nano-bubbles trapped in the electroplated copper layer will limit the quality of the conductive features and therefore reduce production yield of the IC product. Accordingly, forming defect-free conductive features is one of the ongoing efforts in order to improve electrical performance of IC devices.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1A:
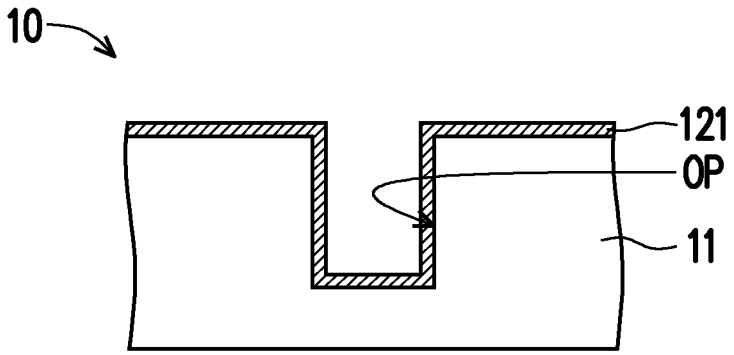
FIGS. 1A-1D are schematic cross-sectional views of various stages of forming a conductive feature of a semiconductor structure according to some embodiments.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

FIGS. 1A-1D are schematic cross-sectional views of various stages of forming a conductive feature of a semiconductor structure according to some embodiments. Referring to FIG. 1A, a base layer 11 of a semiconductor structure 10 is provided with an opening OP, and a seed material layer 121 may be formed on the base layer 11 in a conformal manner. In some embodiments, the base layer 11 is a semiconductor wafer (e.g., silicon wafer) or is a part of a semiconductor wafer. The base layer 11 may be or may include a semiconductor substrate, such as a bulk semiconductor or the like, which may be doped or undoped. Under this scenario, the subsequently formed conductive feature (e.g., 12 in FIG. 1D) may act as a through substrate via (TSV) in the semiconductor structure 10. In some embodiments in which the base layer 11 is a dielectric layer formed over a semiconductor substrate, the conductive feature may be formed as a part of interconnect circuitry in the semiconductor structure 10.

The opening OP may be formed by acceptable removal techniques (e.g., lithography and etching, drilling, and/or the like). The depth of the opening OP may range from submicron to about 100 μm with the aspect ratio (width/depth) ranging from about 1:1 to about 1:20. Although this depth may vary and scale with semiconductor processes. It should be noted that the opening OP which does not penetrate through the base layer 11 is illustrated; however, in some embodiments, the opening OP may penetrate through the base layer 11 to expose element(s) underlying the base layer 11, if desired. It should be appreciated that the cross-sectional shape of the opening is merely an example, and a dual damascene opening including a via hole connecting a trench may be formed in the base layer according to some embodiments.

With continued reference to FIG. 1A, the opening OP may be lined with the seed material layer 121. The material of the seed material layer 121 may include Cu, Ni, Co, Ru, a combination thereof, etc. For example, the seed material layer 121 may include the same conductive material (e.g., Cu) as that used in the subsequent plating process. In some embodiments, the opening OP is initially lined with a barrier liner (not shown), and then the seed material layer 121 is deposited on the barrier liner. The barrier liner may bond the conductive material to the base layer (e.g., the dielectric layer) or may prevent interaction between the conductive material and the base layer (e.g., silicon substrate). For example, the material of the barrier liner includes Ta, TaN, Ti, TiN, a combination thereof, etc.

Figure 1B:
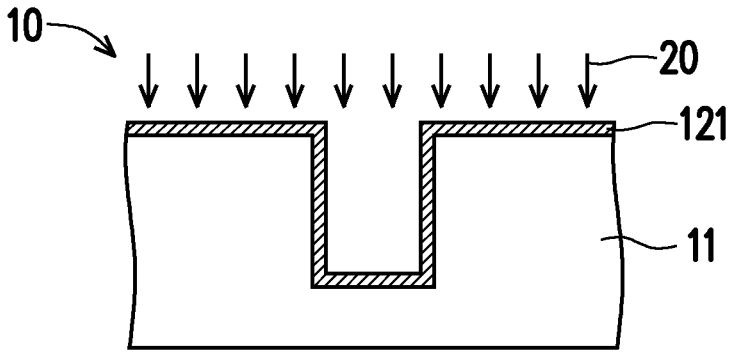

Referring to FIG. 1B, a pre-wetting process 20 is performed on the semiconductor structure 10. For example, the seed material layer 121 is treated with the pre-wetting process 20 to increase wetting ability. The wettability of the seed material layer may be critical for the subsequent plating process. If the seed material layer cannot wet the plating fluid, no plated material can be deposited on that area of the seed material layer, thereby forming a defect. The pre-wetting process may involve wetting the semiconductor structure 10 with fluid. In some cases, jetting the pre-wetting fluid to the semiconductor structure 10 causes the presence of undesirable bubbles. Those bubbles may be pressed into the openings due to pressure difference during the process. During the subsequent plating process, those bubbles in the openings become blocking spots that inhibit plating at those spots and lead to associated defects. The pre-wetting apparatus and pre-wetting method which may avoid the formation of bubbles will be described later in the other embodiments.

Figure 1C:
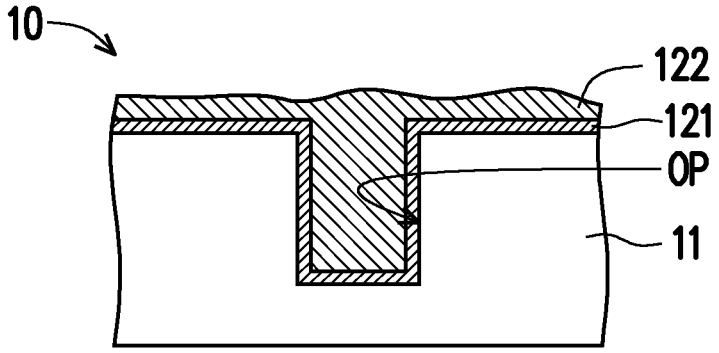

Referring to FIG. 1C, a conductive material layer 122 is formed on the seed material layer 121. The conductive material layer 122 may be a metallic material including a metal or a metal alloy such as copper, silver, gold, tungsten, cobalt, aluminum, or alloys thereof. For example, after the pre-wetting process, electrochemical plating (ECP) is performed to fill the opening OP with the conductive material layer 122. In some embodiments, the semiconductor structure 10 is immersed in an electrolytic bath (not shown). Since the semiconductor structure 10 is electrically biased with respect to the electrolytic bath, the conductive material electrochemically deposits on the semiconductor structure 10. Although electroless plating may be used to form the conductive material layer 122, in accordance with some embodiments.

Figure 1D:
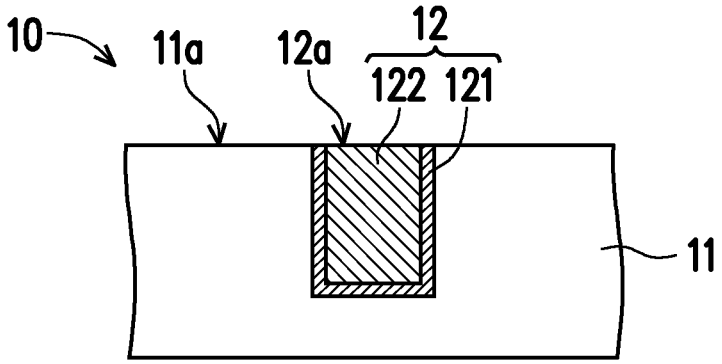

Referring to FIG. 1D, the excess material formed over the major surface Ila of the base layer 11 may be removed to form the semiconductor structure 10 having a conductive feature 12 embedded in the base layer 11. In some embodiments, a planarization (e.g., chemical mechanical polishing, etching, grinding, a combination thereof, etc.) is performed to remove the excess material. In some embodiments, after the planarization, the surfaces of the conductive material layer 122 and the seed material layer 121 form a major surface 12*a* that is substantially level with the major surface 11*a* of the base layer 11. In some embodiments, the barrier liner formed between the base layer 11 and the seed material layer 121 is also removed by the planarization. After the planarization, the remaining portions of the conductive material layer 122 and the seed material layer 121 that are laterally covered by the base layer 11 is collectively viewed as the conductive feature 12.

Figure 2:
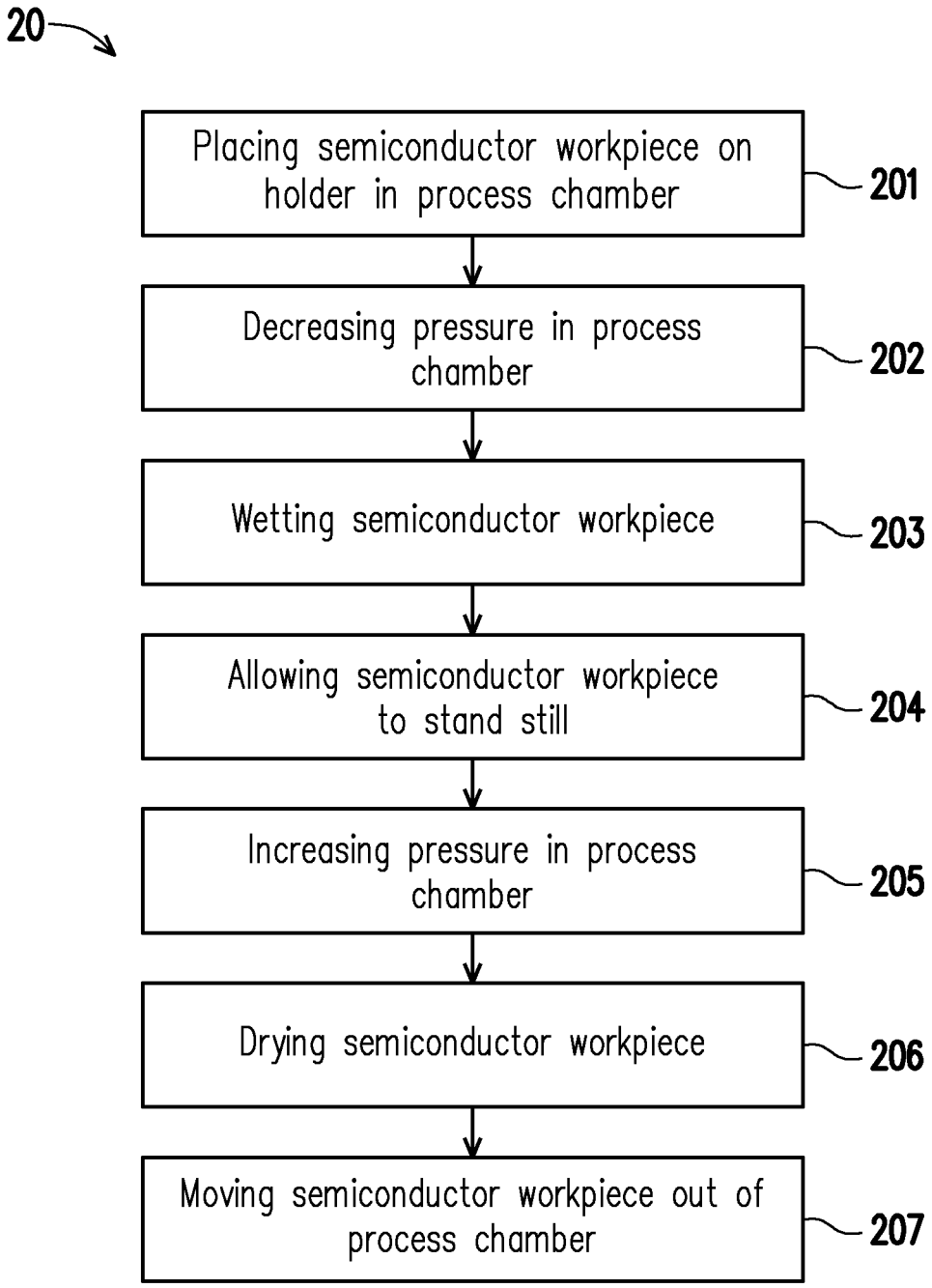
FIG. 2 is a flowchart illustrating a method of pre-wetting a semiconductor structure according to some embodiments.

FIG. 2 is a flowchart illustrating a method of pre-wetting a semiconductor structure according to some embodiments. It is appreciated that although the process 20 is described below as a series of steps, the ordering of such steps is not to be interpreted in a limiting sense. For example, some steps occur in different orders and/or concurrently with other steps apart from those illustrated and/or described herein. In addition, not all illustrated steps may be required to implement one or more aspects or embodiments of the description herein. Further, one or more of the steps depicted herein may be carried out in one or more separate acts and/or phases.

Referring to FIG. 2, at step 201, a semiconductor workpiece is placed on a workpiece holder in a process chamber. The semiconductor workpiece may be a pre-wetting target (e.g., the semiconductor structure 10 shown in FIG. 1B). The semiconductor workpiece to be wetted may be provided in a wafer form and the semiconductor wafer may include a plurality of fields having integrated circuits defined therein, and each field may have one or more semiconductor dies. The semiconductor workpiece is not intended to be limited to any particular type. In some embodiments, forming the seed material layer, pre-wetting, and the subsequent plating are performed in separate chambers (or apparatuses), and thus the semiconductor workpiece may be transferred from the former chamber to the latter chamber. In some embodiments, the process chamber for pre-wetting semiconductor workpieces is part of a plating system. The workpiece holder may include any suitable element or may be provided in any form for carrying and limiting the semiconductor wafer. The details of the process chamber are described later in accompanying with FIGS. 3A-6B.

At step 202, the pressure in the process chamber may be reduced. For example, after placing the semiconductor workpiece, the process chamber is sealed and the pressure within the process chamber is reduced. For example, a vacuum environment is created in the process chamber. In some embodiments, during this step, the air inside the openings of the semiconductor workpiece is evacuated. In some embodiments, a pump (e.g., vacuum pump) is employed to pump down the process chamber from atmospheric pressure to sub-atmospheric pressure. (e.g., a low vacuum pressure). The pump coupled to the process chamber may be utilized to control the pressure within the process chamber to a desired pressure, for example, in a range of about 50 Torr to about 100 Torr.

At step 203, the major surface of the semiconductor workpiece is rinsed with pre-wetting fluid. For example, the pre-wetting fluid is deionized water. Alternatively, the pre-wetting fluid includes deionized water, acid, and/or the like. In some embodiments, the pre-wetting fluid is degassed before contacting the major surface of the semiconductor workpiece. In some embodiments, the sub-atmospheric pressure (e.g., vacuum conditions) is maintained in the process chamber when applying the degassed pre-wetting fluid to the semiconductor workpiece. The semiconductor workpiece held by the workpiece holder may be (or may not be) spun during this step. In some embodiments, the semiconductor workpiece is rotated at a slow rate. For example, the rotational speed is between about 50 rpm to about 100 rpm, such as about 50 rpm. The semiconductor workpiece may be wetted by flooding the major surface with the pre-wetting fluid in a gentle manner to avoid formation of bubbles. The details thereof will be described below in accompanying with FIGS. 3A-6B.

At steps 204-205, after the wetting step, allowing the semiconductor workpiece to stand still for a short time, for example, ranging from about 10 seconds to about 1 minute. In some embodiments, the step 204 is skipped. Next, the pressure within the process chamber may be increased. For example, the vacuum in the process chamber is released. In some embodiments, the process chamber is vented to atmosphere (e.g., about 760 Torr).

At steps 206-207, the semiconductor workpiece is dried to remove the pre-wetting fluid from the major surface. For example, a spin-drying process is performed, where the semiconductor workpiece is spun at a rate ranging from about 200 rpm to about 400 rpm, for a duration ranging from about 10 seconds to about 30 seconds. After the spin-drying is complete, the semiconductor workpiece may sit still for a short time. Other suitable drying method(s) may be employed. Afterwards, the semiconductor workpiece is moved out of the process chamber for further processing (e.g., plating as shown in FIG. 1C).

Figure 3A:
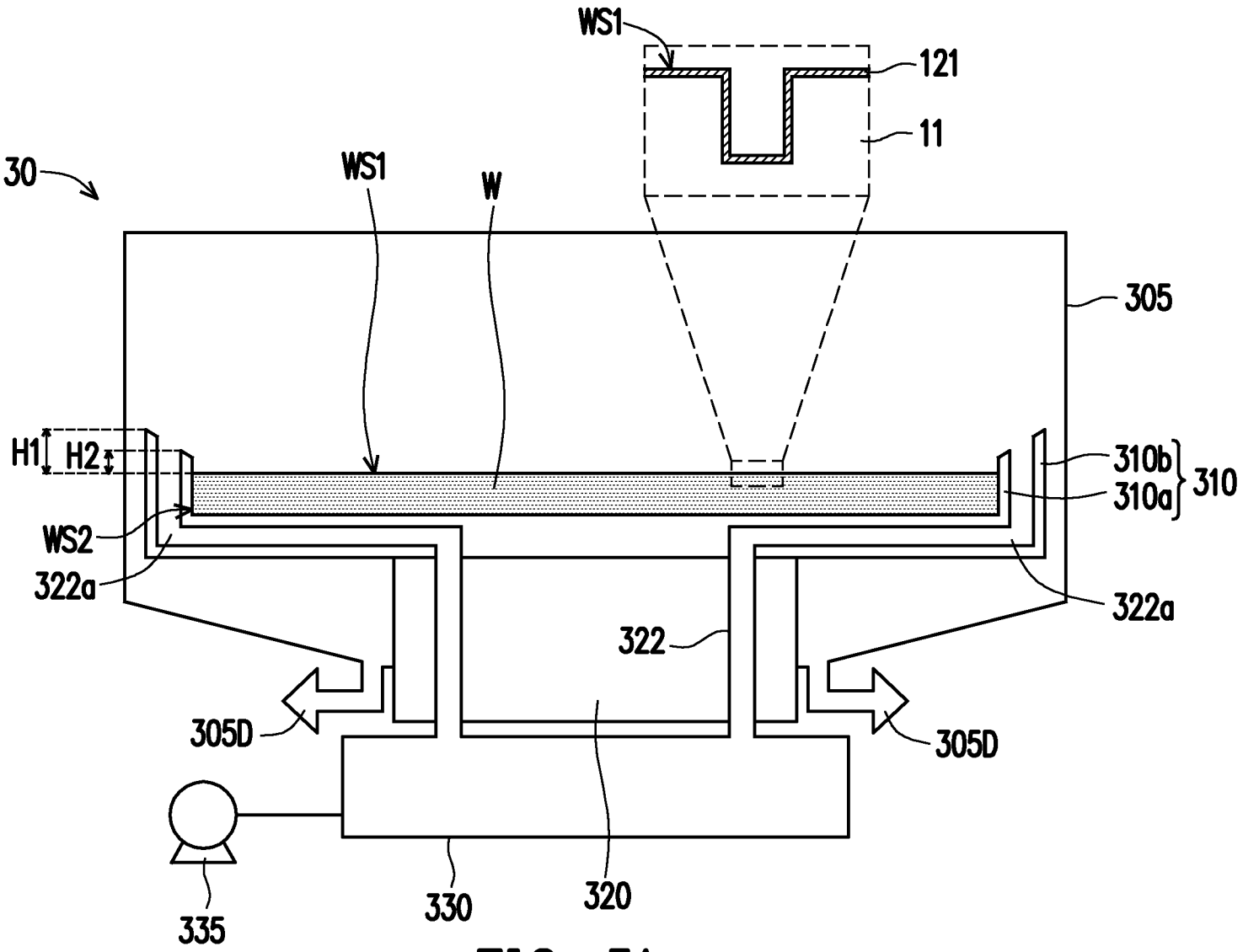
FIG. 3A is a schematic cross-sectional view illustrating a pre-wetting apparatus including a semiconductor workpiece disposed on a workpiece holder according to some embodiments.
Figure 3B:
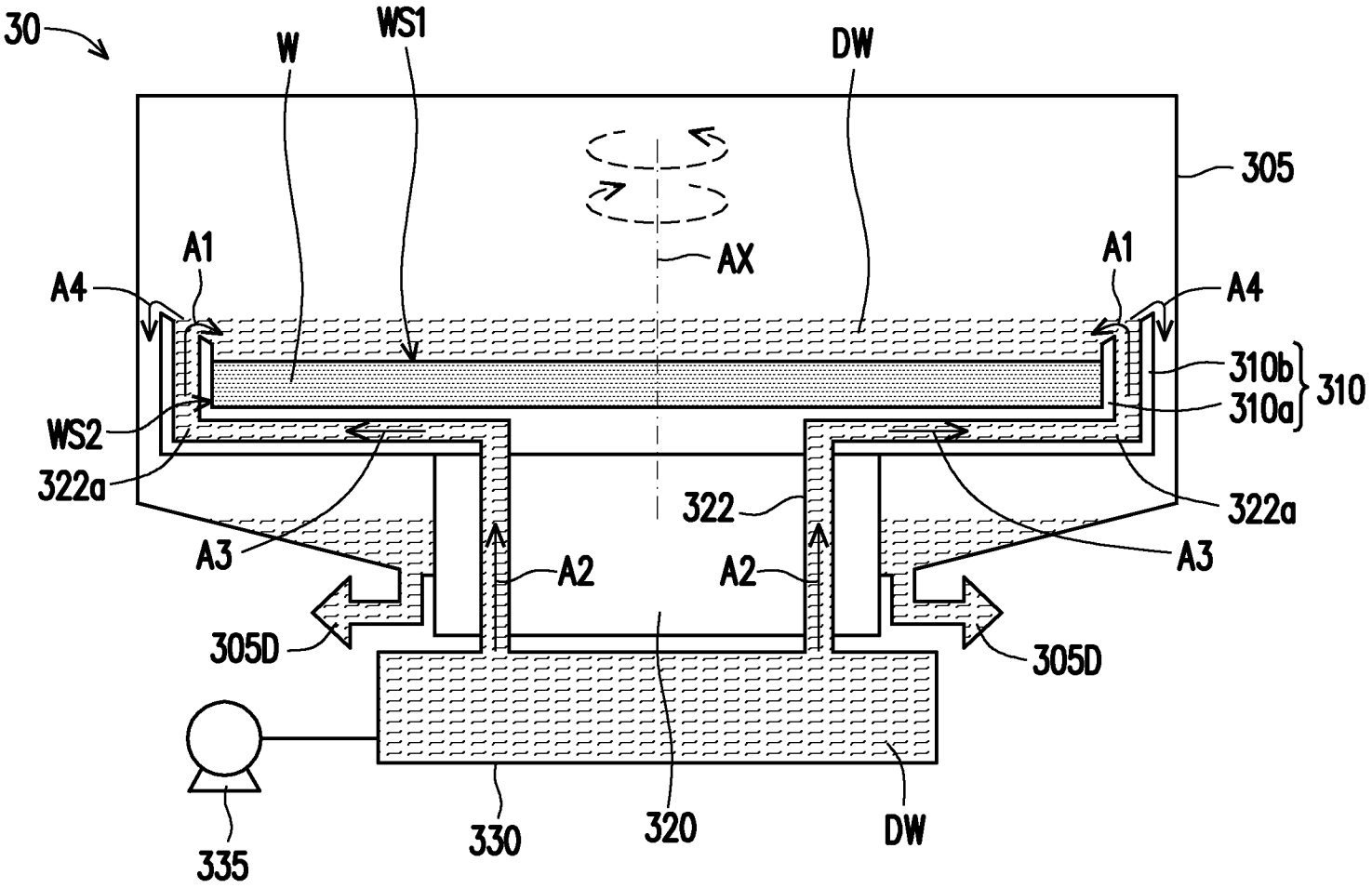
FIG. 3B is a schematic cross-sectional view illustrating a pre-wetting apparatus including a semiconductor workpiece rinsed by pre-wetting fluid according to some embodiments.
Figure 4B:
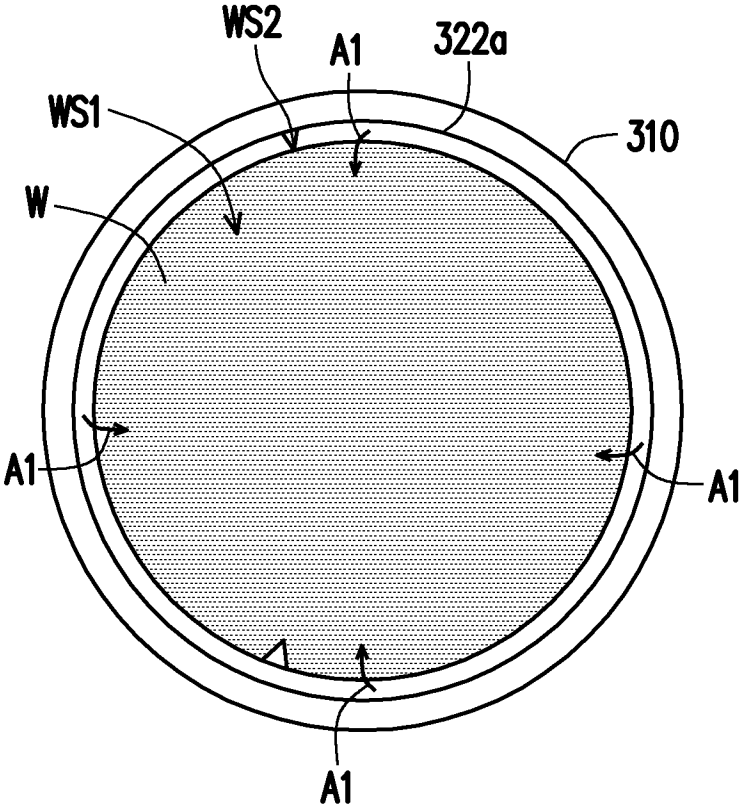
FIGS. 4A-4B are schematic plan views illustrating a semiconductor workpiece disposed on a workpiece holder according to some embodiments.
Figure 4A:
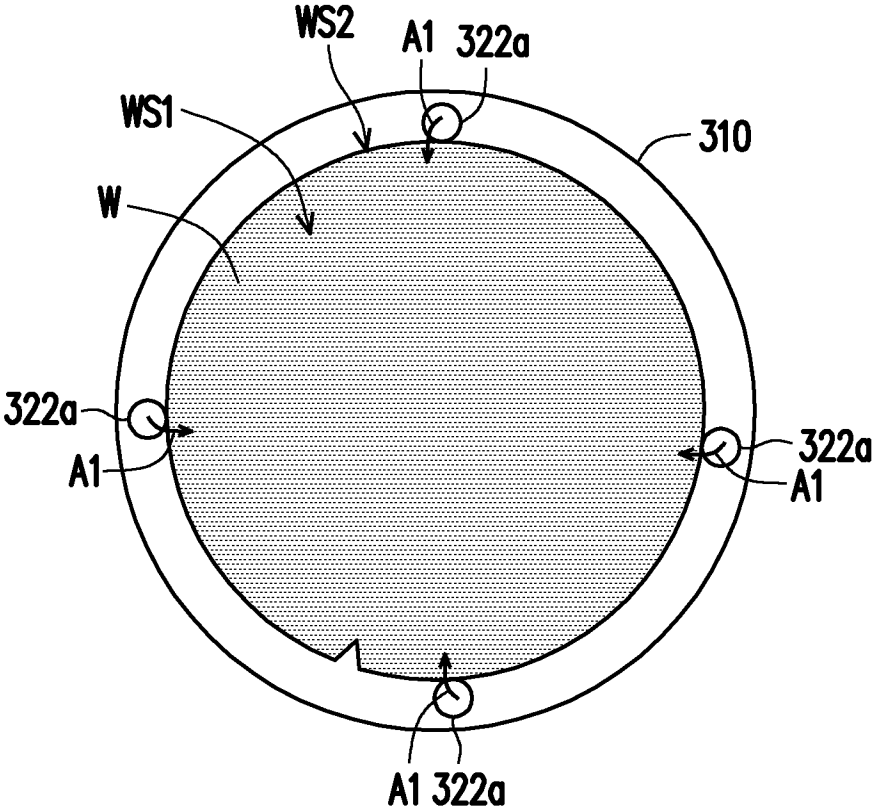

FIG. 3A is a schematic cross-sectional view illustrating a pre-wetting apparatus including a semiconductor workpiece disposed on a workpiece holder and FIG. 3B is a schematic cross-sectional view illustrating a pre-wetting apparatus including a semiconductor workpiece rinsed by pre-wetting fluid, in accordance with some embodiments. FIGS. 4A-4B are schematic plan views illustrating a semiconductor workpiece disposed on a workpiece holder according to some embodiments. The pre-wetting apparatus shown herein may be utilized to perform the process 20 described in FIG. 2. Unless specified otherwise, the components mentioned in FIG. 2 are essentially the same as the like components described below.

Referring to FIG. 3A, a pre-wetting apparatus 30 is provided, and the semiconductor workpiece W is placed on the workpiece holder 310 within the process chamber 305 of the pre-wetting apparatus 30. The semiconductor workpiece W may be a pre-wetting target (e.g., the semiconductor structure 10 shown in FIG. 1B). The major surface WS1 (e.g., the top surface of the seed material layer 121) of the semiconductor workpiece W may be hydrophilic and have recessed features to be wetted and plated. The workpiece holder 310 may be provided in a disk form or may include several arms to support the semiconductor workpiece W. The semiconductor workpiece W is engaged with the workpiece holder 310 using any suitable holding fixture (e.g., pins, clamps, etc.), where the holding fixture may support and/or affix the semiconductor workpiece W during processing. In some embodiments, the workpiece holder 310 is coupled to a moving mechanism 320 (e.g., motor, controller, shaft, combination of these, and/or the like). The moving mechanism 320 is configured to drive the workpiece holder 310 to perform movements (e.g., translate, tilt, rotate, and/or the like) of the semiconductor workpiece W. In some embodiments, the bottom of the process chamber 305 acts as the overflow reservoir for collecting the overflowed pre-wetting fluid. For example, the bottom of the process chamber 305 is provided with drainage ports 305D for draining the overflowed pre-wetting fluid.

In some embodiments, a pre-wetting fluid tank 330 is adapted for delivering the pre-wetting fluid to the semiconductor workpiece W through at least one conduit 332. The pre-wetting fluid tank 330 may be disposed outside the process chamber. Although other configuration of the pre-wetting fluid tank 330 is possible. In some embodiments, a flow control device 335 is disposed upstream of the outlet of the conduit. In some embodiments, the water level in the pre-wetting fluid tank 330 is below the workpiece holder 310, and the pre-wetting fluid tank 330 is equipped with the flow control device 335 (e.g., a pump) for driving the pre-wetting fluid in the pre-wetting fluid tank 330 to flow to the semiconductor workpiece W. Alternatively, the pre-wetting fluid is delivered through the suction generated by a pressure differential between the pre-wetting fluid tank 330 and the process chamber 305.

In some embodiments, the conduits 332 are coupled to the pre-wetting fluid tank 330 and assembled on the workpiece holder 310. Although two conduits 332 are shown, the number of the conduits is not intended to be limiting. For example, portions of the conduits 322 are embedded in the workpiece holder 310 to form channels 322*a* inside the workpiece holder 310. In some embodiments, the channels 322*a* are the hollow passageways in the workpiece holder 310. The flow path of the pre-wetting fluid passing through the channels 322*a* may be below the semiconductor workpiece W and along the sidewalls WS2 of the semiconductor workpiece W. In some embodiments, the channels 322*a* are in fluidic communication with the pre-wetting fluid tank 330, and the pre-wetting fluid may flow to the semiconductor workpiece W through the outlets of the channels 322*a* that are defined by the inner sidewall 310*a* and the outer sidewall 310*b* of the workpiece holder 310. The inner sidewall 310*a* and the outer sidewall 310*b* of the workpiece holder 310 may be substantially parallel to the sidewall WS2 of the semiconductor workpiece W. The outer sidewall 310*b* may be higher than the inner sidewall 310*a* relative to the major surface WS1. In some embodiments, the shortest distance H1 between the top of the outer sidewall 310*b* and a reference plane where the major surface WS1 is located on is greater than the shortest distance H2 between the top of the inner sidewall 310*a* and a reference plane where the major surface WS1 is located on. For example, the inner sidewalls 310*a* and the outer sidewalls 310*b* of the workpiece holder 310 may act as overflow weirs, and the pre-wetting fluid delivering through the channels 322*a* may overflow the inner sidewalls 310*a* prior to overflowing the outer sidewalls 310*b* due to the difference of highness.

With continued reference to FIG. 3A and also referring to FIGS. 4A-4B, the outlets of the channels 322*a* may be provided in any suitable fashion. For example, when viewed from above (e.g., FIG. 4A), the outlets of the channels 322*a* are distributed around the periphery of the semiconductor workpiece W. The pre-wetting fluid may be discharged from these outlet ports and flow to the major surface WS1 of the semiconductor workpiece W as indicated by the arrows A1. In this manner, the major surface WS1 of the semiconductor workpiece W may be wetted from the edge to the center. The outlets may have any top-view shape such as a square shape, a rectangular shape, a circular shape, an elliptical shape, a polygonal shape, etc. It is noted that four outlets shown in FIG. 4A is merely an example, the pre-wetting fluid may be discharged through a single outlet or multiple outlets, and the number of the outlet construes no limitation in the disclosure. In some embodiments, when viewed from above (e.g., FIG. 4B), the outlet of the channels 322*a* is a trench encircling the periphery of the semiconductor workpiece W. The outlet of the channels 322*a* may be a continuous annular trench or may be discontinuous trenches along the perimeter of the semiconductor workpiece W. Other suitable configuration of the outlet may be possible. The pre-wetting fluid may overflow from the trench to the semiconductor workpiece W from the edge to the center as indicated by the arrows A1.

Referring to FIG. 3B, the semiconductor workpiece W is rinsed by the pre-wetting fluid DW. The condition shown in FIG. 3B may correspond to the step 203 described in FIG. 2. In some embodiments, during the wetting step, the semiconductor workpiece W is rotated about an axis AX that passes through its center and is perpendicular to the major surface WS1. For example, the semiconductor workpiece W is driven by the moving mechanism 320 to spin in clockwise (or counterclockwise) direction. Alternatively, the semiconductor workpiece W is not spun during the wetting step. The dashed arrows indicate that the spinning may be or may not be performed during the wetting.

In some embodiments, the pre-wetting fluid DW is degassed prior to delivery to the semiconductor workpiece W. For example, a degasser (not shown) is configured to remove (or reduce) dissolved gases from the pre-wetting fluid DW before entering the conduits 322. In some embodiments, the water level in the pre-wetting fluid tank 330 is below the workpiece holder 310, and the pre-wetting fluid DW in the pre-wetting fluid tank 330 may be delivered upwardly by the conduits 322 as indicated by the arrows A2. Then, the pre-wetting fluid DW may flow through the channels 322*a* in the workpiece holder 310 as indicated by the arrows A3. Next, the pre-wetting fluid DW may overflow the inner sidewall 310*a* of the workpiece holder 310 to contact the major surface WS1 of the semiconductor workpiece W as indicated by the arrows A1. The flow of the pre-wetting fluid DW may mildly wet the major surface WS1 of the semiconductor workpiece W without the formation of bubbles. For example, the wetting rate across the major surface WS1 is regulated by adjusting the fluid pressure of the pre-wetting fluid DW. To avoid fluid jet having a higher fluid pressure being impinged on the major surface, the flow of the pre-wetting fluid DW contacting the major surface WS1 of the semiconductor workpiece W may be regulated to have a relatively low fluid pressure. It is noted that any suitable flow control device (not shown; e.g., valves, controller, sensors, etc.) may be employed for handling the pressure and flow requirements. For example, the fluid pressure is controlled to be in a range of about 10 pounds per square inch (psi) and about 100 psi.

The pre-wetting fluid DW may continuously flow out through the channels 322*a* to wet the semiconductor workpiece W. The excess pre-wetting fluid DW may overflow the outer sidewall 310*b* of the workpiece holder 310 and flow downwardly to the bottom of the process chamber 305 as indicated by the arrows A4. In some embodiments, the pre-wetting fluid DW may fill the recesses features (or openings) on the major surface WS1 of the semiconductor workpiece W due to the pressure differential (e.g., the pressure in the process chamber is increased at the step 205 described in FIG. 2). In some embodiments, during the step 206 described in FIG. 2, the pre-wetting fluid DW is removed from the major surface WS1 of the semiconductor workpiece W and may be collected at the bottom of the process chamber 305, and those pre-wetting fluid DW at the bottom of the process chamber 305 may be discharged through the drainage ports 305D.

Figure 5A:
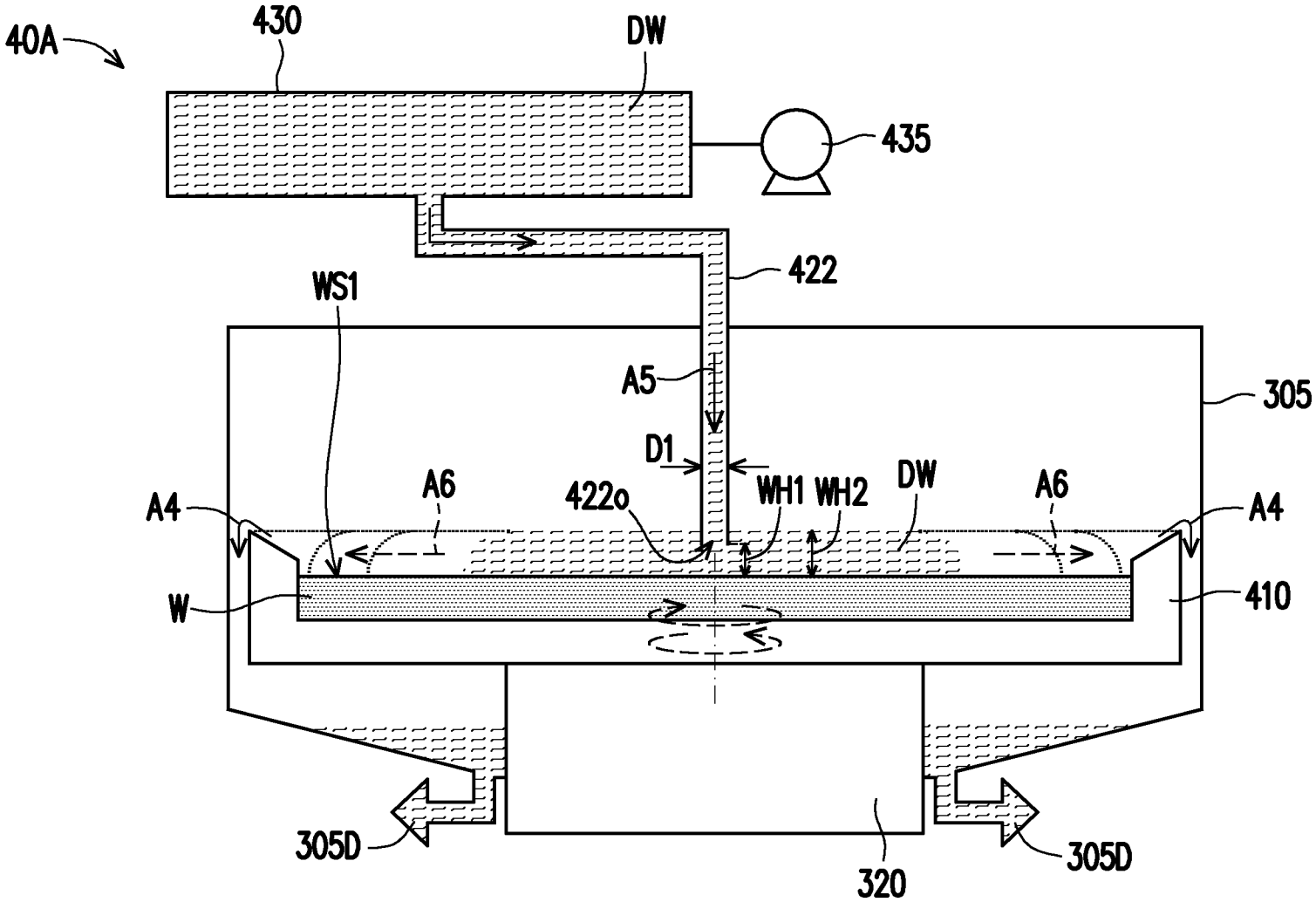
FIG. 5A is a schematic cross-sectional view illustrating a pre-wetting apparatus including a semiconductor workpiece rinsed by pre-wetting fluid according to some embodiments.

FIG. 5A is a schematic cross-sectional view illustrating a pre-wetting apparatus including a semiconductor workpiece rinsed by pre-wetting fluid according to some embodiments. The condition shown in FIG. 5A may correspond to the step 203 described in FIG. 2. The pre-wetting apparatus 40A shown in FIG. 5A is similar to the pre-wetting apparatus 30 shown in FIG. 3A, and thus like reference numbers are used to designate like elements.

Referring to FIG. 5A, the semiconductor workpiece W is wetted by flowing the pre-wetting fluid DW from the pre-wetting fluid tank 430 to the semiconductor workpiece W. The semiconductor workpiece W may be (or may not be) driven by the moving mechanism 320 to spin during the wetting step. In some embodiments, the pre-wetting fluid tank 430 disposed outside the process chamber 305 is coupled to the conduit 422, where the conduit 422 extending into the process chamber 305 is positioned above the semiconductor workpiece W for delivery the pre-wetting fluid DW downwardly to the major surface WS1 of the semiconductor workpiece W. In some embodiments, the lateral dimension D1 (e.g., diameter) of the outlet 422*o* is less than about 3 mm, for example, in a range of about 1 mm to about 3 mm. It should be noted that the lateral dimension D1 may be adjusted depending on the predetermined flow rate and process requirements.

In some embodiments, the conduit 422 is movable inside the process chamber 305 to be located at any desired position. The conduit 422 may be provided as the priming arm or may be part of priming arm which is driven by a controller (not shown) to perform movements (e.g., swinging, lowering down, lifting up, etc.). In some embodiments, the outlet 422*o* of the conduit 422 is positioned above the center of the major surface WS1 of the semiconductor workpiece W by a vertical distance WH1. Alternatively, the outlet 422*o* of the conduit 422 is positioned above the edge or anywhere else of the major surface WS1 of the semiconductor workpiece W.

In some embodiments, the pre-wetting fluid tank 430 is equipped with the flow control device 435, and the pre-wetting fluid DW in the pre-wetting fluid tank 430 may be fed into the conduit 422 by the flow control device 435. The flow control device 435 may include at least one pump (e.g., syringe pump, pressure based pump, etc.), valves, motors, pipelines, etc. Other suitable device which is configured to pressure control and flow rate control may be utilized. By regulating the flow rate and the pressure of the pre-wetting fluid DW delivering to the semiconductor workpiece W, the semiconductor workpiece W may be rinsed in a gentle manner. For example, the fluid pressure is controlled to be in a range of about 5 psi and about 50 psi.

In some embodiments, the pre-wetting fluid DW is initially degassed and delivered by the conduits 422. For example, there is no air bubble inside the conduits 422 during the delivery of the pre-wetting fluid DW using any suitable technique. In some embodiments, the outlet 422*o* of the conduit 422 is above the semiconductor workpiece W and at the position close to the major surface WS1 of the semiconductor workpiece W, and the pre-wetting fluid DW flows out through the outlet 422*o* to contact the major surface WS1 of the semiconductor workpiece W, as indicated by the arrows A5. For example, the vertical distance WH1 between the outlet 422*o* of the conduit 422 and the major surface WS1 of the semiconductor workpiece W is in a range of about 1 mm to about 3 mm. The vertical distance WH1 may be regulated before, during, and after delivery the pre-wetting fluid DW to the semiconductor workpiece W.

In some embodiments, as the pre-wetting fluid DW continuously flowing to the semiconductor workpiece W, the pre-wetting fluid DW is accumulated on the major surface WS1 of the semiconductor workpiece W, and the position of the outlet 422*o* is kept to be lower than the height (water level) of the pre-wetting fluid DW relative to the major surface WS1. For example, the outlet 22*o* of the conduit 422 is submerged under the pre-wetting fluid DW over the major surface WS1. In some embodiments, the vertical distance WH1 is less than the vertical distance WH2 that is between the fluid surface of the pre-wetting fluid DW surrounding the conduit 422 and the major surface WS1 of the semiconductor workpiece W. In some embodiments, as the continuous delivery of the pre-wetting fluid DW to the semiconductor workpiece W, the pre-wetting fluid DW gradually and slowly spreads in a radial direction to the edges as indicated by the dashed arrows A6. It is noted that the flow path of the pre-wetting fluid DW on the semiconductor workpiece W is illustrated in the dashed lines. For example, the flow of pre-wetting fluid DW over the major surface WS1 of the semiconductor workpiece W is in a "creeping" flow regime, in order to prevent the fluid jet from impinging on the major surface WS1. The wetting rate across the major surface WS1 may be regulated by adjusting the fluid pressure. The creeping flow regime may be achieved by, for example, optimizing the size of the outlet 422*o* and the length of the conduit 422, regulating the fluid pressure and velocity through the flow control device 435, etc. It should be noted that the term "creeping flow" used herein may refer to the flow with lower fluid pressure and velocity (or flow rate).

The spreading flow rate of the pre-wetting fluid DW over the semiconductor workpiece W may be regulated to avoid turbulence and/or the formation of bubbles. For example, the application of the flow control device 435 facilitates control of the fluid pressure and flow rate of the pre-wetting fluid DW fed into the conduit 422. The lateral dimension D1 of the outlet 422*o* may be designed to have the small amount of the pre-wetting fluid DW flowing out through the outlet 422*o*. In this manner, the pre-wetting fluid DW may gently wet the major surface WS1 of the semiconductor workpiece W to prevent the fluid jet from hitting the major surface WS1. In some embodiments, when wetting the semiconductor workpiece W, keeping the outlet 422*o* submerged in the pre-wetting fluid DW may prevent air bubbles from being introduced into the pre-wetting fluid DW over the semiconductor workpiece W. As continuous flooding the major surface WS1 of the semiconductor workpiece W with the pre-wetting fluid DW, the excess pre-wetting fluid DW over the semiconductor workpiece W may overflow the top surface of the workpiece holder 410 as indicated by the arrow A4, and then the overflowed pre-wetting fluid DW may be discharged through the drainage ports 305D.

Figure 5B:
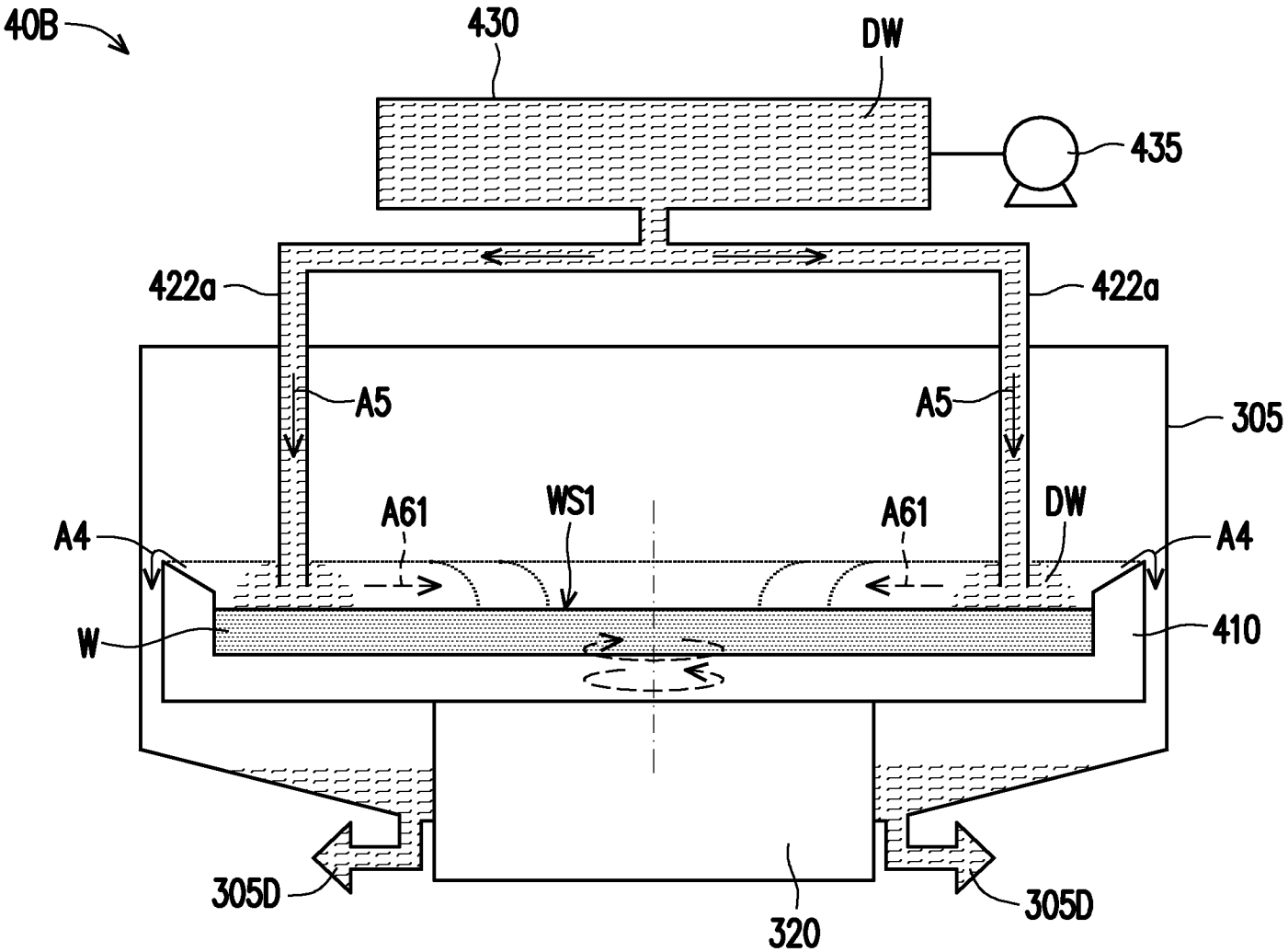
FIG. 5B is a schematic cross-sectional view illustrating another variation of a pre-wetting apparatus shown in FIG. 5A according to some embodiments.

FIG. 5B is a schematic cross-sectional view illustrating another variation of a pre-wetting apparatus shown in FIG. 5A according to some embodiment, and thus the details of the apparatus are not repeated for the sake of brevity. Referring to FIG. 5B and with reference to FIG. 5A, the difference between the pre-wetting apparatus 40B and the pre-wetting apparatus 40A in FIG. 5A includes that a plurality of conduits 422*a* is configured to convey the pre-wetting fluid DW. Although two conduits are shown, it is understood that more than two conduits may be configured. In some embodiments, the conduits 422*a* are positioned above the semiconductor workpiece W to deliver the pre-wetting fluid DW from the pre-wetting fluid tank 430 toward the semiconductor workpiece W as indicated by the arrows A5. The conduits 422*a* may be distributed along the perimeter of the semiconductor workpiece W, and the pre-wetting fluid DW flowing to the semiconductor workpiece W may spread from the edges to the center of the major surface WS1 of the semiconductor workpiece W as indicated by the dashed arrows A61. In some embodiments, one of the conduits is positioned at the center of the semiconductor workpiece W and another one of the conduits is positioned at the edge of the semiconductor workpiece W. Again, other configuration of the conduits may be possible.

Figure 6A:
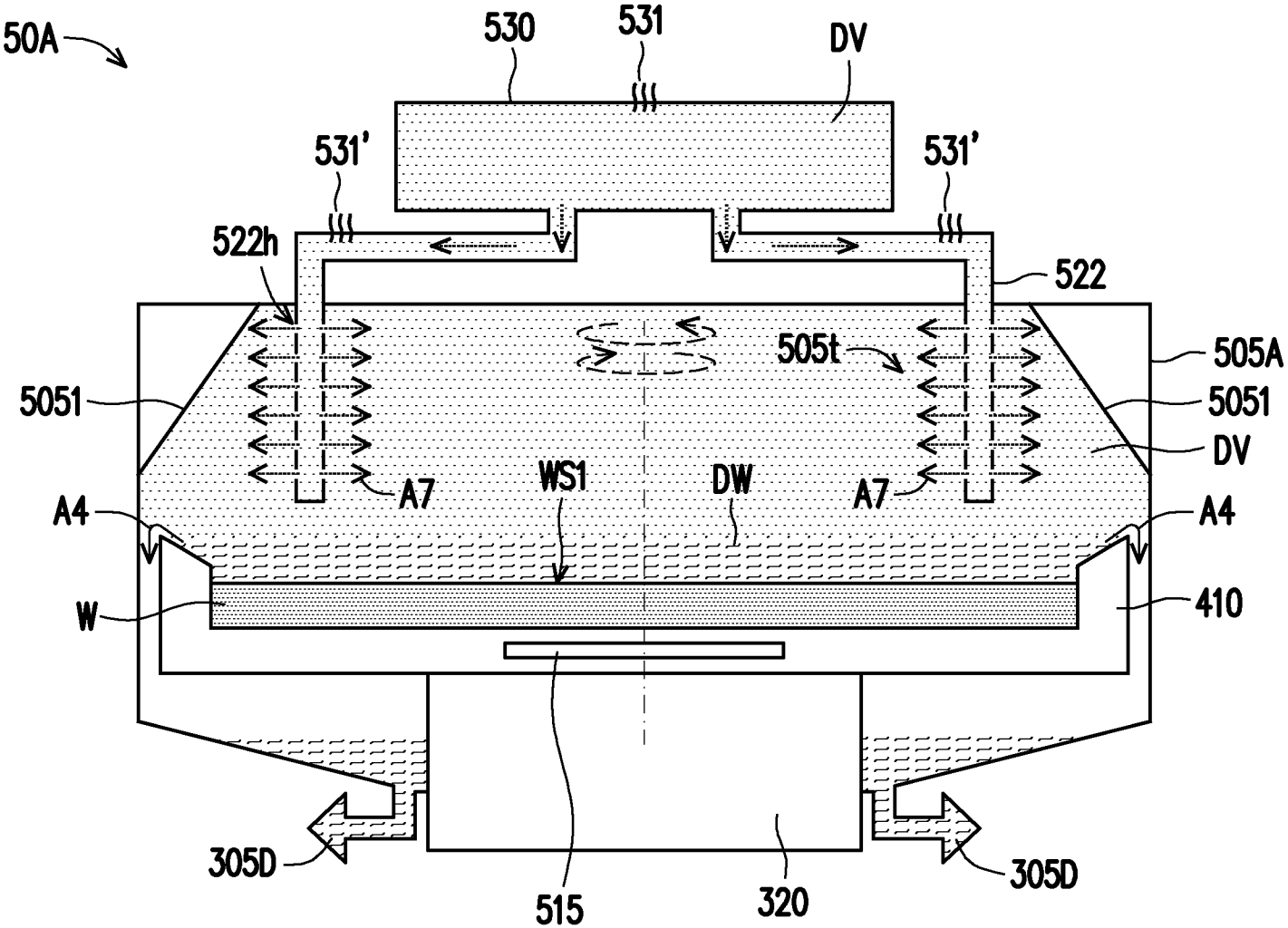
FIG. 6A is a schematic cross-sectional view illustrating a pre-wetting apparatus including a semiconductor workpiece rinsed by pre-wetting fluid according to some embodiments.

FIG. 6A is a schematic cross-sectional view illustrating a pre-wetting apparatus including a semiconductor workpiece rinsed by pre-wetting fluid according to some embodiments. The pre-wetting apparatus 50A shown in FIG. 6A is similar to the pre-wetting apparatus 30 described in FIGS. 3A-3B, like reference numbers are used to designate like elements, and the details of the similar elements are not repeated for the sake of brevity. The condition shown in FIG. 6A may correspond to the step 203 described in FIG. 2. The dashed arrows indicate that the spinning may be or may not be performed during the wetting.

Referring to FIG. 6A, the conduits 522 are coupled to the pre-wetting fluid tank 530 and extend into the process chamber 505A to deliver the pre-wetting fluid from the pre-wetting fluid tank 530 into the process chamber 505A in vapor form. In some embodiments, the pre-wetting fluid is condensable fluid vapors which may be (or may not be) degassed prior to introducing into the process chamber 505A. As used herein, the pre-wetting fluid in vapor form is called pre-wetting vapors DV. In some embodiments, the pre-wetting vapors DV are formed by vaporization of deionized water. The pre-wetting vapors DV may include other substances depending on process requirements. The pre-wetting fluid tank 530 may contain high moisture content (e.g., about 100% relative humidity). For example, the pre-wetting fluid tank 530 is equipped with a heating device 531 (e.g., heater, hot plate, vapor generator, and/or the like) configured to heating the pre-wetting fluid and allowing pre-wetting fluid to vaporize. In some embodiments, the temperature in the pre-wetting fluid tank 530 is maintained to be higher than about 90° C. Although the temperature in the pre-wetting fluid tank may vary depending on the content and pressure of the pre-wetting fluid.

In some embodiments, to ensure that the pre-wetting vapors DV flowing into the process chamber 505A without condensation inside the conduits, the conduits 522 are kept in a heating condition using, for example, the heating device 531'. The heating device 531' equipped with the conduits 522 may be the same or similar to the heating device 531 equipped with the pre-wetting fluid tank 530. It is understood that the number and the configuration of the conduits and the heating devices construe no limitation in the disclosure. For example, portions of the conduits 522 extending into the process chamber 505A are positioned at the upper portion 505*t* of the process chamber 505A above the semiconductor workpiece W, and the portions of the conduits 522 may include a plurality of holes (or outlets) 522*h* distributed on the sidewalls of the conduits 522. The pre-wetting vapors DV may enter the process chamber 505A through the holes 522*h* as indicated by the dashed arrows A7. In some embodiments, the portions of the conduits 522 are disposed in a vertical (or tilted) manner relative to the major surface WS1 of the semiconductor workpiece W to avoid the fluid droplets directly falling onto the major surface WS1 of the semiconductor workpiece W. It is understood that the number, the size, and the configuration of the holes are shown for illustrative purpose only and may vary depending on process requirements.

In some embodiments, the process chamber 505A includes tilted surfaces 5051 connected to the chamber sidewall and the ceiling. The tilted surfaces 5051 may be configured to prevent the condensation of the pre-wetting vapors DV on the top of the process chamber that resides above and possibly falls onto the semiconductor workpiece W. For example, the condensation of the pre-wetting vapors DV on the ceiling of the process chamber 505A is directed to the overflow reservoir (e.g., the bottom of the process chamber) through the tilted surfaces 5051 and then drained through the drainage ports 305D. It is noted that the tilt angles of the tilted surfaces 5051 relative to the sidewalls of the process chamber 505A may depend on chamber design and construe to limitation in the disclosure. The tilted surfaces 5051 may be replaced with any suitable flow-directing plate or other configuration.

With continued reference to FIG. 6A, the workpiece holder 510 of the pre-wetting apparatus 50A may be equipped with a temperature control device 515 (e.g., thermoelectric cooling device, heat exchanging device, cooling plate, and/or the like). In some embodiments, the temperature control device 515 is configured to reduce the temperature of the semiconductor workpiece W disposed on the workpiece holder 510. For example, during the wetting step, the temperature of the semiconductor workpiece W is reduced to a temperature below the condensation temperature (e.g., dew point temperature) of the pre-wetting vapors DV using the temperature control device 515. In this manner, the pre-wetting vapors DV introducing into the process chamber 505A may be allowed to condense to form pre-wetting fluid DW on the major surface WS1 of the semiconductor workpiece W. The condensation temperature may vary depending on parameters (e.g., the content of the pre-wetting fluid, the operation pressure in the process chamber, etc.).

In some embodiments, to facilitate the condensation process performed onto the major surface WS1 of the semiconductor workpiece W, the operation temperature in the process chamber 505A is set to be higher than the condensation temperature (e.g., dew point temperature) of the pre-wetting vapors DV to avoid condensation on the chamber sidewalls and/or the ceiling. As continuous delivery of the pre-wetting vapors DV through the holes 522*h* of the conduits 522, the pre-wetting vapors DV condensing over the major surface WS1 of the semiconductor workpiece W may gradually form a flow of the pre-wetting fluid DW that wets the major surface WS1. The condensation process performed onto the semiconductor workpiece W may form the pre-wetting fluid DW over the major surface WS1 in a slow manner without formation of bubbles. In some embodiments, the recessed portions of the major surface WS1 of the semiconductor workpiece W are filled with the condensed pre-wetting fluid DW during the wetting step and when the pressure in the process chamber 505A is changed (e.g., step 205). The excess pre-wetting fluid DW over the semiconductor workpiece W may overflow the top surface of the workpiece holder 510 as indicated by the arrow A4, and then the overflowed pre-wetting fluid may be discharged through the drainage ports 305D.

Figure 6B:
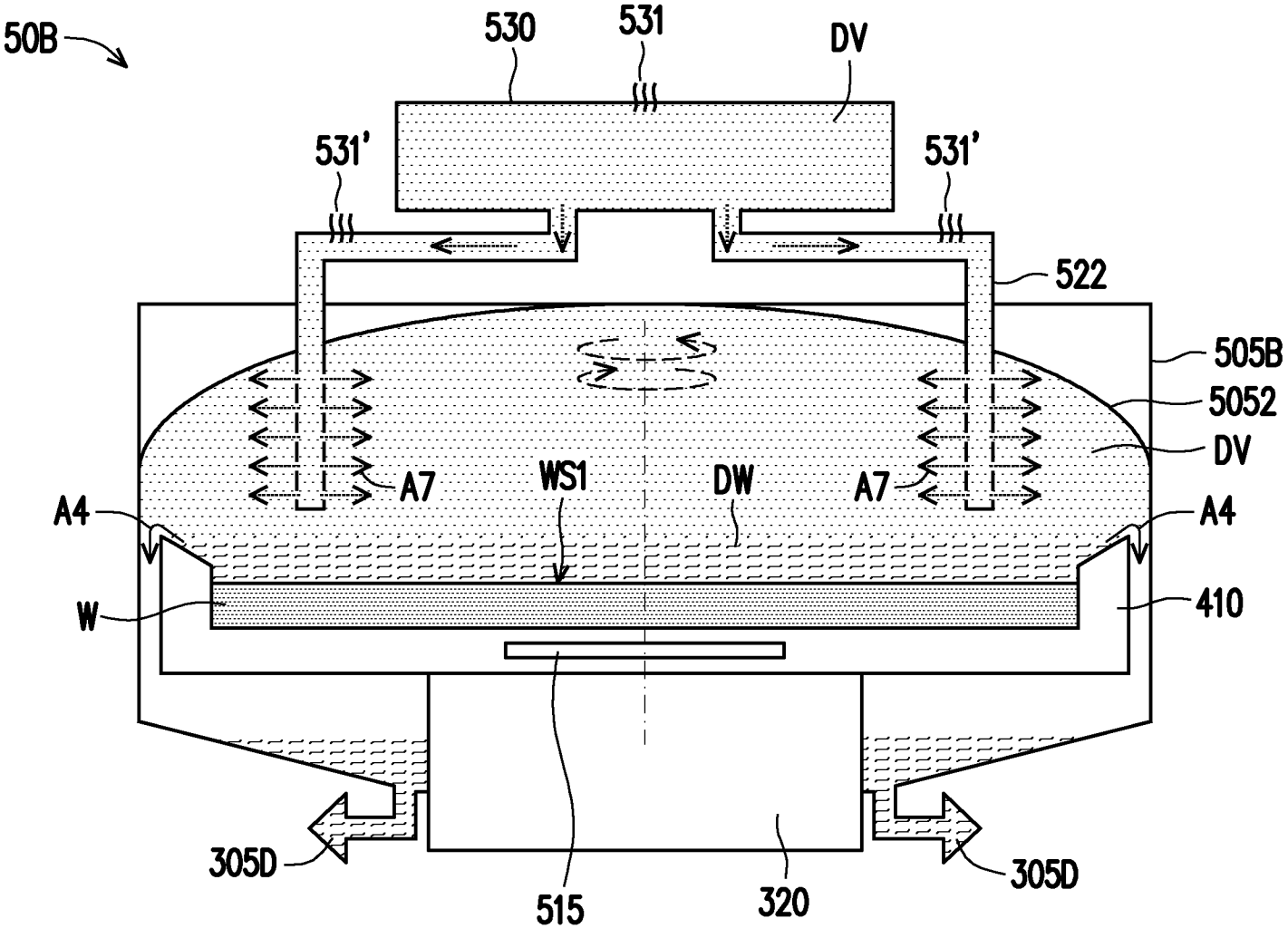
FIG. 6B is a schematic cross-sectional view illustrating another variation of a pre-wetting apparatus shown in FIG. 6A according to some embodiments.

FIG. 6B is a schematic cross-sectional view illustrating another variation of a pre-wetting apparatus shown in FIG. 6A according to some embodiments. Like reference numbers are used to designate like elements, and the details of the similar elements are not repeated for the sake of brevity. Referring to FIG. 6B and with reference to FIG. 6A, the difference between the pre-wetting apparatus 50B and the pre-wetting apparatus 50A in FIG. 6A lies in that the process chamber 505A includes a dome-shaped ceiling 5052. For example, the dome-shaped ceiling 5052 is engaged with the chamber sidewalls to form vacuum seal, if desired. During the wetting step, the condensed pre-wetting fluid DW formed on the top of the process chamber 505B, if present, may be directed to the overflow reservoir (e.g., the bottom of the process chamber) and then drained through the drainage ports 305D. By configuring the dome-shaped ceiling 5052, the condensation of the pre-wetting vapors DV on the top of the process chamber resides above and possibly falls onto the semiconductor workpiece W may be prevented.

In accordance with some embodiments, a semiconductor apparatus for pre-wetting a semiconductor workpiece includes a process chamber, a workpiece holder disposed within the process chamber to hold the semiconductor workpiece, a pre-wetting fluid tank disposed outside the process chamber and containing a pre-wetting fluid, and a conduit coupled to the pre-wetting fluid tank and extending into the process chamber. The conduit delivers the pre-wetting fluid from the pre-wetting fluid tank out through an outlet of the conduit to wet a major surface of the semiconductor workpiece comprising a plurality of recess portions.

In accordance with some embodiments, a method of processing a semiconductor workpiece includes at least the following steps. The semiconductor workpiece is pre-wetted. The pre-wetting includes decreasing a pressure in a process chamber that contains a semiconductor workpiece held by a workpiece holder, flowing a pre-wetting fluid to the semiconductor workpiece to wet a major surface of the semiconductor workpiece which comprises a plurality of recessed portions, and increasing the pressure in the process chamber. A wetting rate across the major surface is regulated by adjusting a fluid pressure of the pre-wetting fluid, and the recessed portions of the semiconductor workpiece is filled with the pre-wetting fluid during increasing the pressure. The pre-wetting fluid is removed from the semiconductor workpiece, and a conductive material is plated on the semiconductor workpiece.

In accordance with some embodiments, a method of processing a semiconductor workpiece includes at least the following steps. A vacuum is applied to a process chamber that contains the semiconductor workpiece held by a workpiece holder, pre-wetting vapors are introduced into the process chamber, and the pre-wetting vapors condense on the major surface of the semiconductor workpiece that comprises a plurality of recessed portions.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A semiconductor apparatus for pre-wetting a semiconductor workpiece, comprising:

a process chamber;

a workpiece holder disposed within the process chamber to hold the semiconductor workpiece;

a pre-wetting fluid tank disposed outside the process chamber and containing a pre-wetting fluid; and a conduit coupled to the pre-wetting fluid tank and extending into the process chamber, the conduit delivering the pre-wetting fluid from the pre-wetting fluid tank out through an outlet of the conduit to wet a major surface of the semiconductor workpiece comprising a plurality of recess portions, wherein the workpiece holder comprises an inner sidewall and an outer sidewall, wherein a portion of the conduit is in the workpiece holder, the outlet of the conduit is separated from the semiconductor workpiece by the inner sidewall, the outer sidewall is higher than the inner sidewall relative to the major surface of the semiconductor workpiece, and an excess portion of the pre-wetting fluid overflows from the outer sidewall of the workpiece holder.

2. The semiconductor apparatus of claim 1, wherein the inner sidewall is in contact with an edge of the semiconductor workpiece, and the pre-wetting fluid flowing through the conduit overflows from the inner sidewall of the workpiece holder to the major surface of the semiconductor workpiece.

3. The semiconductor apparatus of claim 1, further comprising:

a moving mechanism coupled to and disposed below the workpiece holder, wherein the semiconductor workpiece is driven by the moving mechanism to rotate about an axis that passes through a center of the semiconductor workpiece and is perpendicular to the major surface of the semiconductor workpiece.

4. The semiconductor apparatus of claim 1, wherein the conduit comprises:

a first channel in fluidic communication with the pre-wetting fluid tank, extending in a first direction inside the workpiece holder, and disposed below the major surface of the semiconductor workpiece; and a second channel in fluidic communication with the first channel, extending in a second direction inside the workpiece holder, and disposed in proximity to a sidewall of the semiconductor workpiece.

5. The semiconductor apparatus of claim 4, wherein the pre-wetting fluid flows from the pre-wetting fluid tank, passes through the first channel toward the second channel, and discharges from the outlet to reach an edge of the semiconductor workpiece.

6. The semiconductor apparatus of claim 1, wherein the outlet of the conduit comprises a plurality of holes distributed around a periphery of the semiconductor workpiece in a top view.

7. The semiconductor apparatus of claim 1, wherein the outlet of the conduit is an annular trench encircling a periphery of the semiconductor workpiece in a top view.

8. The semiconductor apparatus of claim 1, wherein the pre-wetting fluid overflows from the outlet of the conduit to reach a periphery of the major surface of the semiconductor workpiece and then to a center of the major surface of the semiconductor workpiece.

9. The semiconductor apparatus of claim 1, wherein a water level of the pre-wetting fluid tank is below a position of the workpiece holder, and the pre-wetting fluid tank is equipped with a pump to deliver the pre-wetting fluid in the pre-wetting fluid tank to the semiconductor workpiece disposed on the workpiece holder.

10. The semiconductor apparatus of claim 1, wherein the inner sidewall and the outer sidewall are spatially separated from each other by the conduit, and a containing space is defined by the inner sidewall.

11. The semiconductor apparatus of claim 10, wherein the semiconductor workpiece is disposed in the containing space.

12. A semiconductor apparatus for pre-wetting a semiconductor workpiece, comprising:

a process chamber;

a workpiece holder disposed within the process chamber to hold the semiconductor workpiece;

a pre-wetting fluid tank disposed outside the process chamber and containing a pre-wetting fluid; and a conduit coupled to the pre-wetting fluid tank and extending into the process chamber, the conduit delivering the pre-wetting fluid from the pre-wetting fluid tank out through an outlet of the conduit to wet a major surface of the semiconductor workpiece, wherein the workpiece holder comprises an inner sidewall and an outer sidewall spatially separated from each other by the conduit, wherein a portion of the conduit is in the workpiece holder, the outlet of the conduit is separated from the semiconductor workpiece by the inner sidewall, the outer sidewall is higher than the inner sidewall relative to the major surface of the semiconductor workpiece, and an excess portion of the pre-wetting fluid overflows from the outer sidewall of the workpiece holder.

13. The semiconductor apparatus of claim 12, wherein a first shortest distance between a top of the outer sidewall of the workpiece holder and a reference plane where the major surface of the semiconductor workpiece is located on is greater than a second shortest distance between a top of the inner sidewall and the reference plane where the major surface of the semiconductor workpiece is located on.

14. A method of processing a semiconductor workpiece, comprising:

pre-wetting the semiconductor workpiece comprising:

decreasing a pressure in a process chamber that contains a semiconductor workpiece held by a workpiece holder, wherein the workpiece holder comprises an inner sidewall and an outer sidewall, a conduit is coupled to a pre-wetting fluid tank and extending into the process chamber, wherein a portion of the conduit is in the workpiece holder, an outlet of the conduit is separated from the semiconductor workpiece by the inner sidewall, the outer sidewall is higher than the inner sidewall relative to a major surface of the semiconductor workpiece, and an excess portion of a pre-wetting fluid overflows from the outer sidewall of the workpiece holder;

by delivering the pre-wetting fluid from the pre-wetting fluid tank out through the outlet of the conduit, flowing the pre-wetting fluid to the semiconductor workpiece to wet the major surface of the semiconductor workpiece which comprises a plurality of recessed portions, wherein a wetting rate across the major surface is regulated by adjusting a fluid pressure of the pre-wetting fluid; and increasing the pressure in the process chamber, wherein the recessed portions of the semiconductor workpiece is filled with the pre-wetting fluid;

removing the pre-wetting fluid from the semiconductor workpiece; and plating a conductive material on the semiconductor workpiece.

15. The method of claim 14, wherein flowing the pre-wetting fluid to the semiconductor workpiece comprises:

flowing the pre-wetting fluid inside the workpiece holder; and overflowing the pre-wetting fluid from the inner sidewall of the workpiece holder to the major surface of the semiconductor workpiece.

16. The method of claim 15, wherein pre-wetting the semiconductor workpiece further comprises:

discharging the excess portion of the pre-wetting fluid.

17. The method of claim 15, wherein flowing the pre-wetting fluid inside the workpiece holder comprises:

flowing the pre-wetting fluid upwardly from the pre-wetting fluid tank through a first channel of the conduit;

flowing the pre-wetting fluid horizontally through a second channel of the conduit, wherein the second channel is connected to the first channel and embedded in the workpiece holder; and flowing the pre-wetting fluid upwardly through a third channel of the conduit, wherein the third channel is connected to the second channel and embedded in the workpiece holder.

18. The method of claim 14, wherein a fluid pressure of the pre-wetting fluid flowing to the semiconductor workpiece is regulated in range of 10 psi and 100 psi.

19. The method of claim 14, wherein flowing the pre-wetting fluid to the semiconductor workpiece comprises:

accumulating the pre-wetting fluid on the major surface of the semiconductor workpiece; and keeping the outlet of the conduit submerged in the pre-wetting fluid on the major surface of the semiconductor workpiece.

20. The method of claim 19, wherein flowing the pre-wetting fluid to the semiconductor workpiece comprises:

keeping the pre-wetting fluid flowing in the conduit being bubble-free.

* * * * *